US010854032B2

(12) United States Patent
Sichich

(10) Patent No.: US 10,854,032 B2
(45) Date of Patent: Dec. 1, 2020

(54) VENDING MACHINE

(71) Applicant: EVOCA S.p.A., Milan (IT)

(72) Inventor: Roberto Sichich, Milan (IT)

(73) Assignee: EVOCA S.P.A., Milan (IT)

( * ) Notice: Subject to any disclaimer, the term of this patent is extended or adjusted under 35 U.S.C. 154(b) by 0 days.

(21) Appl. No.: 16/426,025

(22) Filed: May 30, 2019

(65) Prior Publication Data

US 2019/0371108 A1 Dec. 5, 2019

(30) Foreign Application Priority Data

Jun. 1, 2018 (IT) ..... 102018000005953

(51) Int. Cl.
*G07F 11/24* (2006.01)
*G07F 11/00* (2006.01)

(52) U.S. Cl.
CPC ..... *G07F 11/007* (2013.01); *G07F 11/24* (2013.01)

(58) Field of Classification Search
None
See application file for complete search history.

(56) References Cited

U.S. PATENT DOCUMENTS 4,190,178 A 2/1980 Lebron
8,386,074 B2 * 2/2013 Smith, III ..... G07F 9/006 221/96
8,678,232 B2 * 3/2014 Mockus ..... G07F 11/00 198/698
2006/0131322 A1 * 6/2006 Pesenti Barili ..... G07F 11/16 221/85
2008/0135574 A1 6/2008 Hieb et al.
2010/0094457 A1 * 4/2010 Garson ..... G07F 9/026 700/242
2011/0147402 A1 * 6/2011 Valota ..... G07F 11/42 221/1
2014/0183213 A1 * 7/2014 Chen ..... G07F 11/38 221/197
2014/0184036 A1 7/2014 Chen et al.

FOREIGN PATENT DOCUMENTS

EP 2415031 A1 2/2012
GB 1209818 A 10/1970
WO 2010112448 A1 10/2010

* cited by examiner

*Primary Examiner* — Gene O Crawford
*Assistant Examiner* — Ayodeji T Ojofeitimi
(74) *Attorney, Agent, or Firm* — Dorsey & Whitney LLP

(57) ABSTRACT

A vending machine has a cabinet internally defining a dispensing compartment that is closed by a front door and houses a plurality of dispensing trays, each of which supports a plurality of products and is slidably engaged in a guide device defined by a pair of elongated guides, each of which is coupled to the cabinet through a front tooth and a rear tooth and is provided with a retractable spring-loaded locking pin movable between a coupling position and a release position with respect to the cabinet.

10 Claims, 6 Drawing Sheets

VENDING MACHINE

CROSS-REFERENCE TO RELATED APPLICATION(S)

This patent application claims priority to Italian Patent Application No. 102018000005953 filed on Jun. 1, 2018, the entire disclosure of which is incorporated herein by reference.

TECHNICAL FIELD OF THE INVENTION

The present invention relates to a vending machine. In particular, the present invention relates to a vending machine of the type comprising a cabinet defining a dispensing compartment, a front door to close the dispensing compartment and a plurality of dispensing trays arranged inside the dispensing compartment, each of them supporting a respective plurality of products.

STATE OF THE ART

Each dispensing tray is slidably engaged in a guide device comprising a pair of guides that have an elongated shape and are coupled to the cabinet on opposite sides of the dispensing tray.

Each guide comprises a front end provided with at least a first cabinet coupling tooth and a rear end provided with at least a second cabinet coupling tooth.

The dispensing compartment is bounded by two side walls, each of which has a plurality of first slots aligned in a vertical direction and configured to receive the first coupling tooth and is further provided with a plurality of second slots aligned in the vertical direction and configured to receive the second coupling tooth.

Once coupled to the relative side wall by means of the first coupling tooth and of the second coupling tooth, each guide is fastened on the relative side wall by means of at least one fastening screw.

The vending machines of known products of the type described above have some drawbacks, mainly deriving from the fact that, when the arrangement of the guide devices inside the cabinet must be modified based on the shape of the products arranged on the dispensing trays, the presence of the aforementioned fastening screws involves a relatively long and uncomfortable sequence of disassembly and assembly operations for the operating personnel.

OBJECT AND SUMMARY OF THE INVENTION

The object of the present invention is to provide a vending machine that is free from the above disadvantages and that is simple and inexpensive to manufacture.

According to the present invention, a vending machine is provided as claimed in the appended claims.

BRIEF DESCRIPTION OF THE DRAWINGS

The present invention will now be described with reference to the annexed drawings showing a non-limiting embodiment, in which.

DETAILED DESCRIPTION OF PREFERRED EMBODIMENTS OF THE INVENTION

Figure 1:
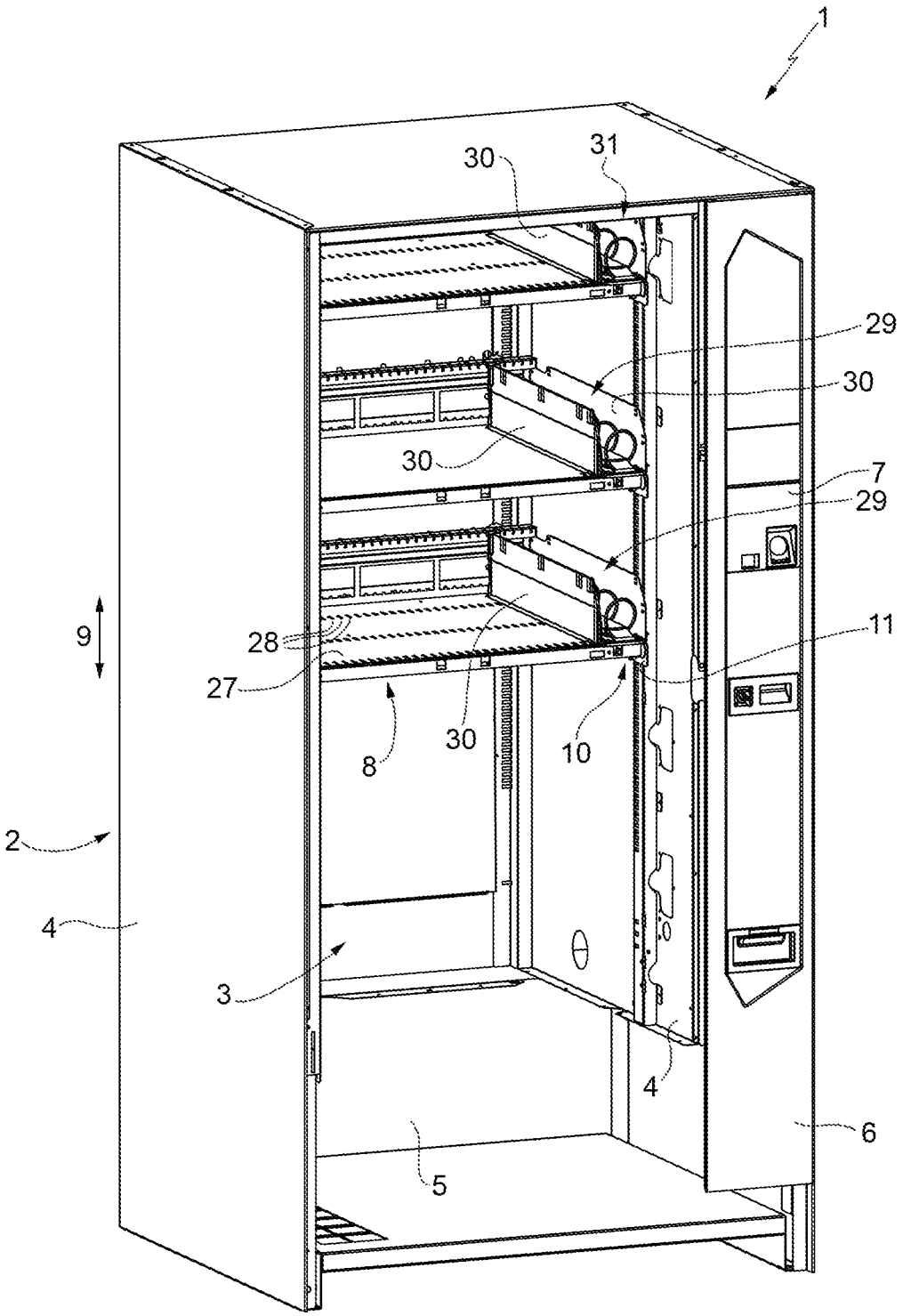
FIG. 1 is a perspective view, with parts removed for clarity's sake, of a preferred embodiment of the vending machine of the present invention.

With reference to FIG. 1, the reference number 1 indicates, as a whole, a vending machine (not shown) comprising a cabinet 2 internally defining a dispensing compartment 3, which is bounded by two substantially parallel side walls 4 and by a rear wall 5 substantially perpendicular to the walls 4, and is closed by an at least partially transparent front door 6.

At a lower portion of the door 6 it is provided a tilting door (not shown), which defines a collection space connected to the compartment 3 and designed to be opened by a user to collect a product previously selected by means of a push-button selection panel 7 along a side edge of the door 6.

The compartment 3 houses a plurality of dispensing trays 8, which are arranged one over the other in a substantially vertical direction 9 and extend between the walls 4, each of them supporting a respective plurality of products (not shown).

Each tray 8 has a depth, measured perpendicularly to the wall 5, smaller than the distance between the wall 5 and the door 6, which is also measured perpendicularly to the wall 5, so as to define a product falling space communicating with the aforementioned collection space of the tilting door (not shown) of the door 6.

Each tray 8 is slidably engaged in a guide device 10 to move between a dispensing position (FIG. 1), in which the tray 8 is arranged inside the cabinet 2 to allow the products (not shown) to be dispensed, and a loading position (not shown), in which the tray 8 projects outside the cabinet 2 to allow the products (not shown) to be loaded onto the tray 8.

The device 10 comprises a pair of rectilinear guides 11 coupled to the walls 4 on opposite sides of the tray 8.

Figure 2:
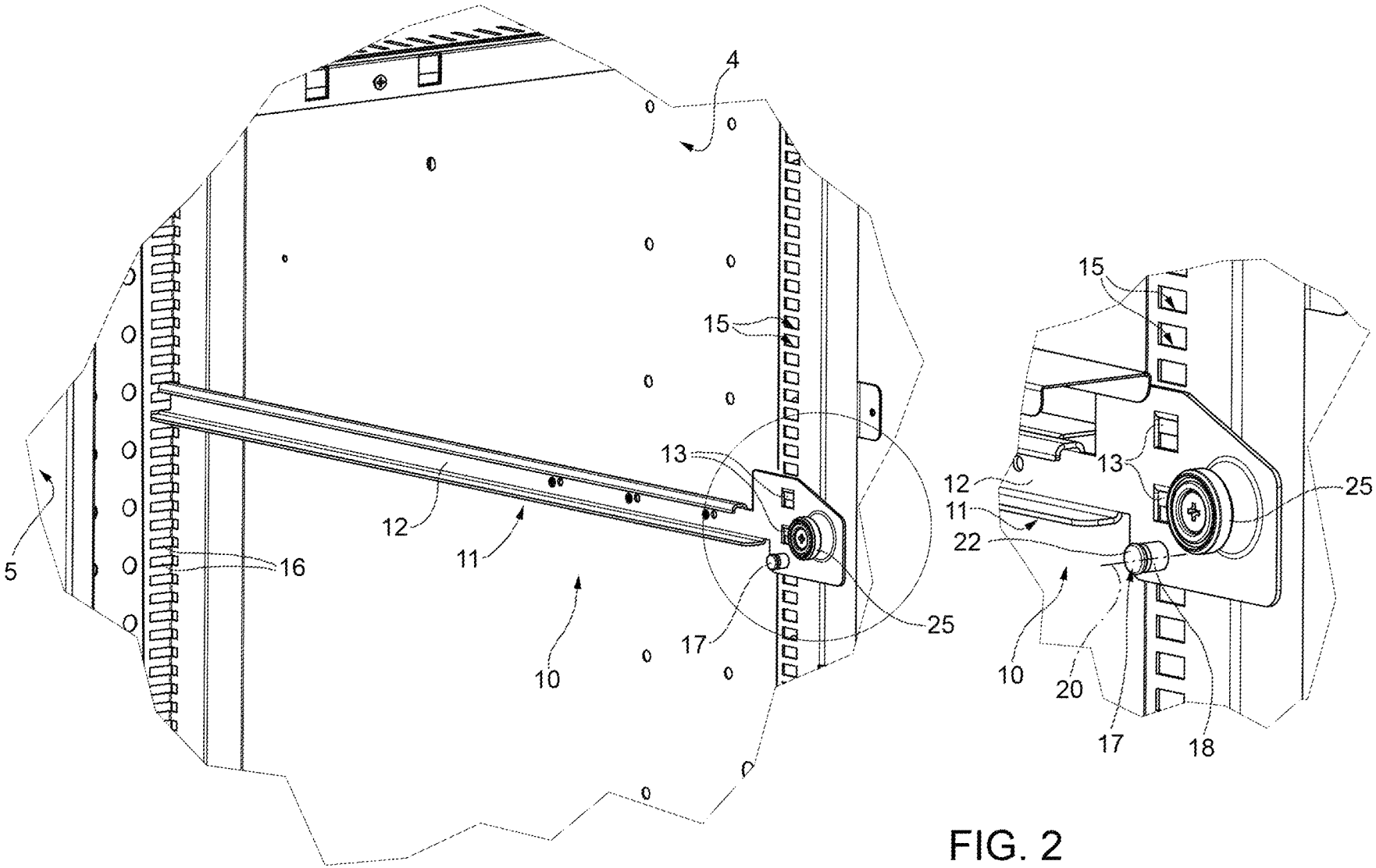
FIG. 2 shows, with parts removed for clarity's sake, a detail of the vending machine of FIG. 1.
Figure 3:
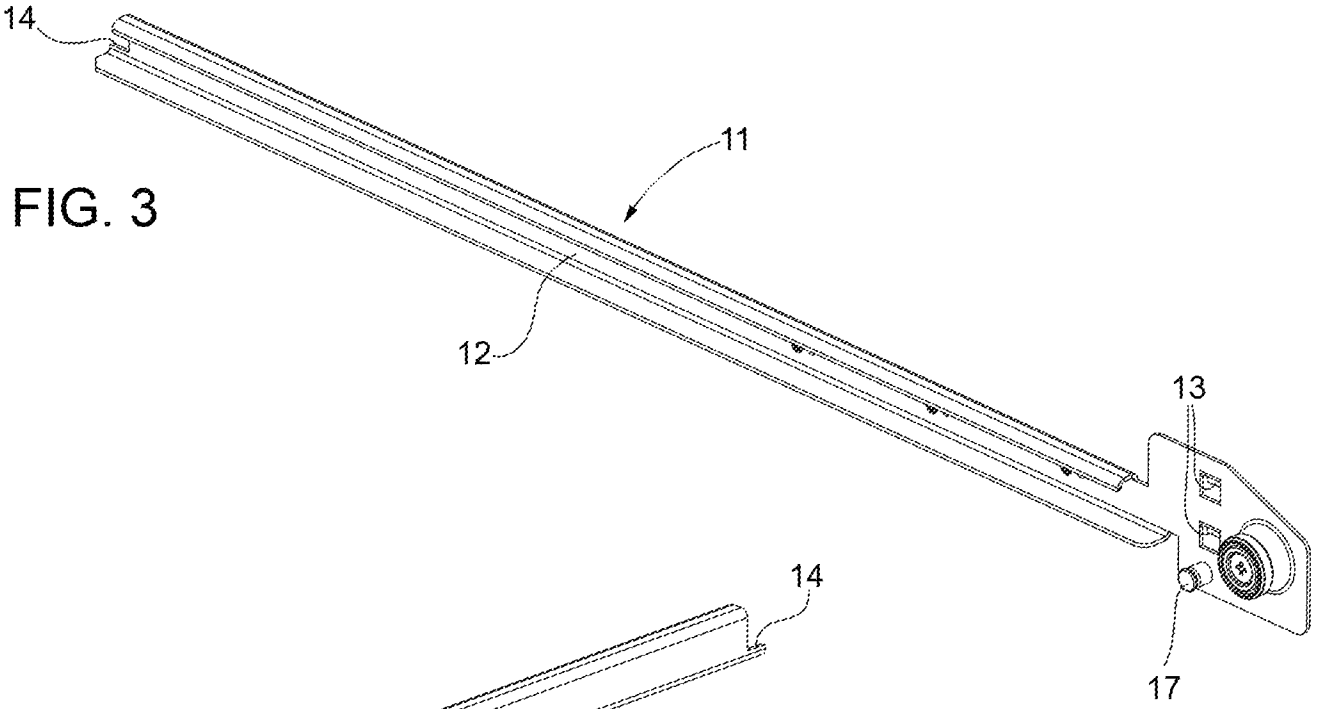
FIGS. 3 and 4 are perspective views, from different angles, of a detail of FIG. 2.
Figure 4:
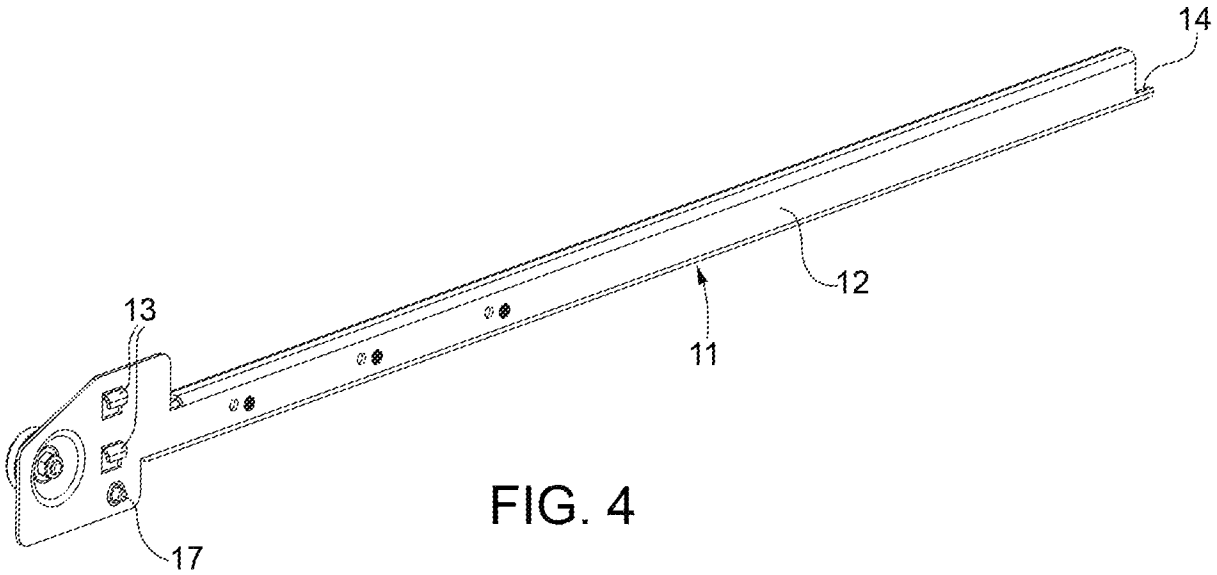

As shown in FIGS. 2 to 4, each guide 11 has an elongated shape and comprises an associated plate 12 having a front end provided with at least one coupling tooth 13 (in this case two teeth 13), a rear end provided with at least one coupling tooth 14 and a U-shaped central portion, with the opening facing the compartment 3 when the guide is mounted in the cabinet 2.

Each wall 4 has a plurality of slots 15, which are aligned in the direction 9, are distributed with a constant distribution pitch in the direction 9 and are configured to receive the teeth 13 of the guides 11.

The wall 5 has two pluralities of slots 16 parallel to each other and to the direction 9. The slots 16 of each plurality of slots 16 are aligned in the direction 9, are distributed with a constant distribution pitch in the direction 9 and are configured to receive the teeth 14 of the guides 11.

Each guide 11 is further provided with a locking pin 17, which is mounted through the associated plate 12, and is designed to lock the guide 11 in position during the assembly of this latter after the teeth 13 and 14 have engaged the related slots 15 and 16.

In particular, the pin 17 is of the retractable spring-loaded type and comprises a sleeve 18, which is arranged on the side of the plate 12 that, when the guide 11 is mounted on the cabinet 2, faces the compartment 3 and is coaxial to a hole 19 formed in the plate 12 and having an axis 20 perpendicular to the plate 12.

The sleeve 18 is integral with the plate 12. In the example illustrated in the attached drawings, the coupling between the plate 12 and the sleeve 18 is made by coupling, by pressure or by threading, an axial end of the sleeve 18 and the hole 19. However, any other type of suitable coupling can be used to lock the sleeve 18 to the plate 12, for example a coupling by welding.

The hole 19 and the sleeve 18 are arranged on the plate 12 in alignment with the teeth 13 and their distance from the nearest tooth 13 is equal to the distance between the two teeth 13, namely is equal to the pitch of the slots 15 on the wall 4. According to a different embodiment (not illustrated), the distance of the pin 17 from the tooth 13 is equal to a multiple of the pitch of the slots 15.

Figure 8:
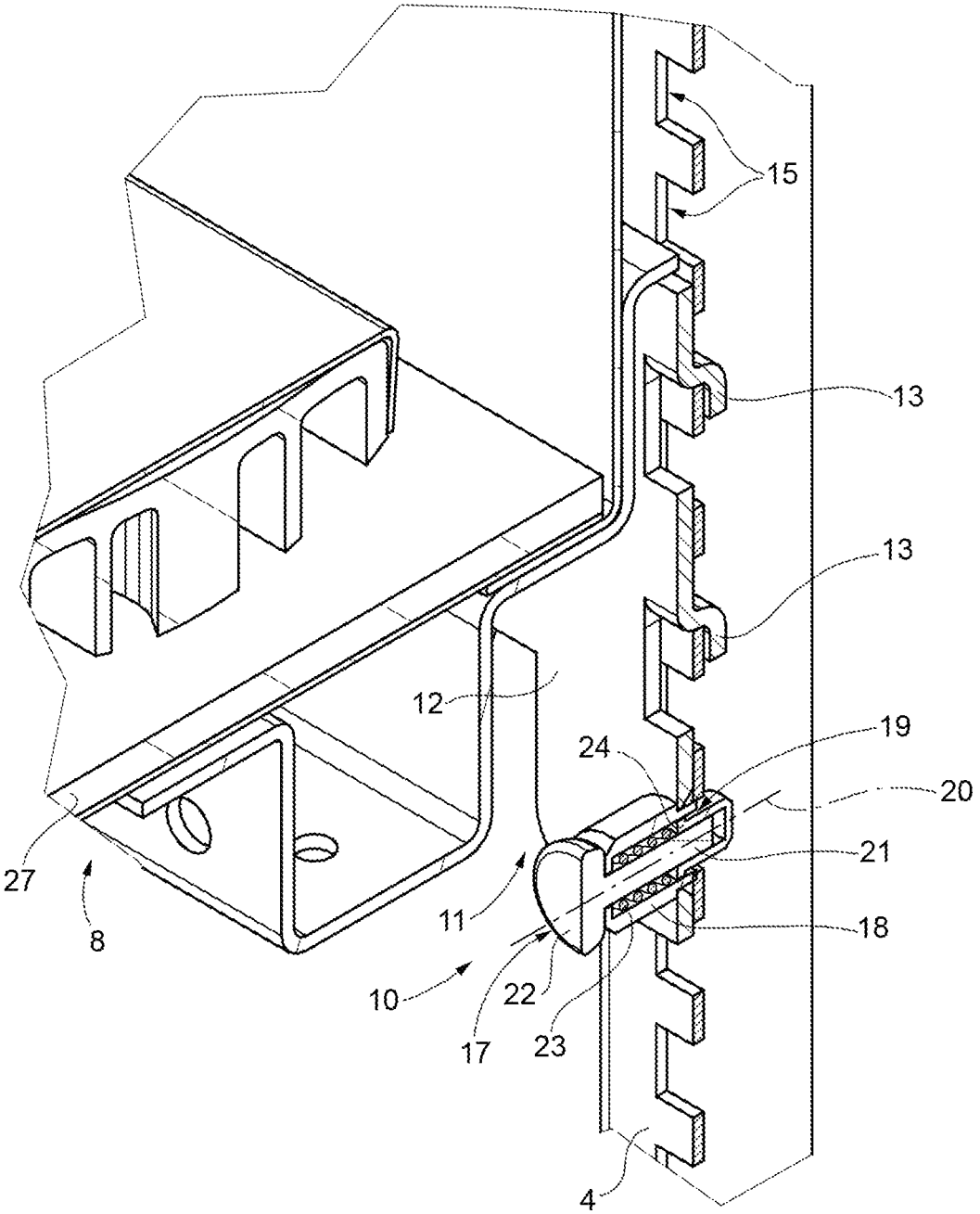
FIG. 8 is a perspective view, with parts in section and parts removed for clarity's sake, of a detail of FIGS. 5 and 6.

The pin 17 further comprises a piston 21, which in turn comprises a head 22 projecting from the free end of the sleeve 18, and a stem 21 and is slidably mounted inside the sleeve 18 to move against the thrust of a return spring 23 between a normal extracted coupling position (FIG. 8), in which the stem 21 extends through the hole 19 of the plate 12 and the head 22 abuts against the end of the sleeve 18, and a retracted release position (not shown), in which the stem 21 does not protrude beyond the hole 19 and the head 22 is detached from the free end of the sleeve 18.

In particular, the spring 23 is a helical spring fitted in the sleeve 18 between an end of the sleeve 18 and an annular flange 24 integral with the stem 21 and slidably coupled to an inner surface of the sleeve 18.

According to a different embodiment (not illustrated), the pin 17 comprises only a piston provided with a head and a stem, and the spring is wound around the stem and compressed between the head and the plate 12.

When the guide 11 is mounted on the cabinet 2, the pin 17 is arranged in the normal extracted coupling position (FIG. 5), in which the stem 21 of the pin 17 transversely engages a slot 15 so as to lock the guide 11 on the relative wall 4.

When the guide 11 is to be released from the cabinet, the operator moves the pin 17 into the retracted release position so that the stem 21 disengages from the relative slot 15, and keeps the pin 17 in this position while pulling out the teeth 13 from the slots 15 and the tooth 14 from the slot 16 with appropriate movements.

Once the guide 11 has been removed from the cabinet 2, the pin 17 is released and returns to its normal extracted position.

On the contrary, when the guide 11 is to be mounted, the operator puts the guide 11 closer to the walls 4 and 5 to align the teeth 13 and 14 to the respective slots 15 and 16. The pin 17 is compressed and moves into the retracted release position by effect of the thrust exerted by the operator, through the guide 11, on the stem 21 against the wall 4. After having inserted the teeth 14 in the slots 16, the operator moves the guide 11 downwards until the teeth 13 are inserted in the slots 15. During this movement, the pin 17 is free to be move back, under the thrust of the spring 23, into the extracted coupling position, thus engaging a corresponding slot 15.

It follows that, advantageously, the assembly operation of the guide 11 can be performed without the use of tools.

As shown in 2, 3, 5 and 7, the guide 11 finally comprises a roller 25 arranged in the front part of the guide 11 close to the pin 17 to define a bearing surface designed to be slidably engaged by an edge 26 of a frame of the tray 8 when this latter is extracted from the cabinet 2 along the respective guides 11. The roller 25 is further configured to engage a recess (not shown) formed on the edge 26 of the tray 8, when this latter is positioned inside the cabinet 2 on the respective guides 11, thus providing a safety device to prevent the accidental sliding of the tray 8 towards the door 6.

Figure 5:
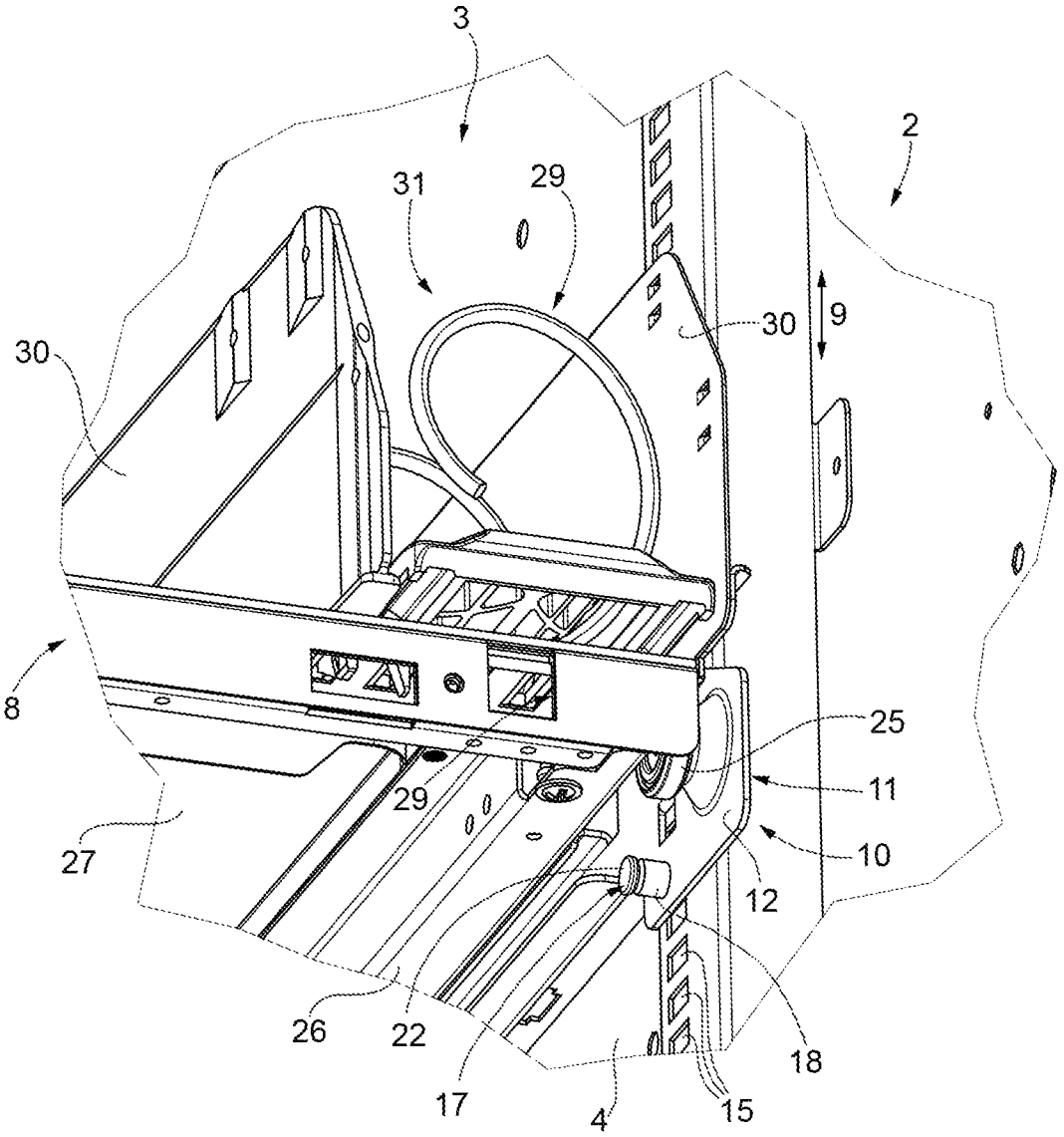
FIGS. 5 and 6 are perspective views, with parts removed for clarity's sake and from two different angles, of a detail of the vending machine of FIG. 1.
Figure 6:
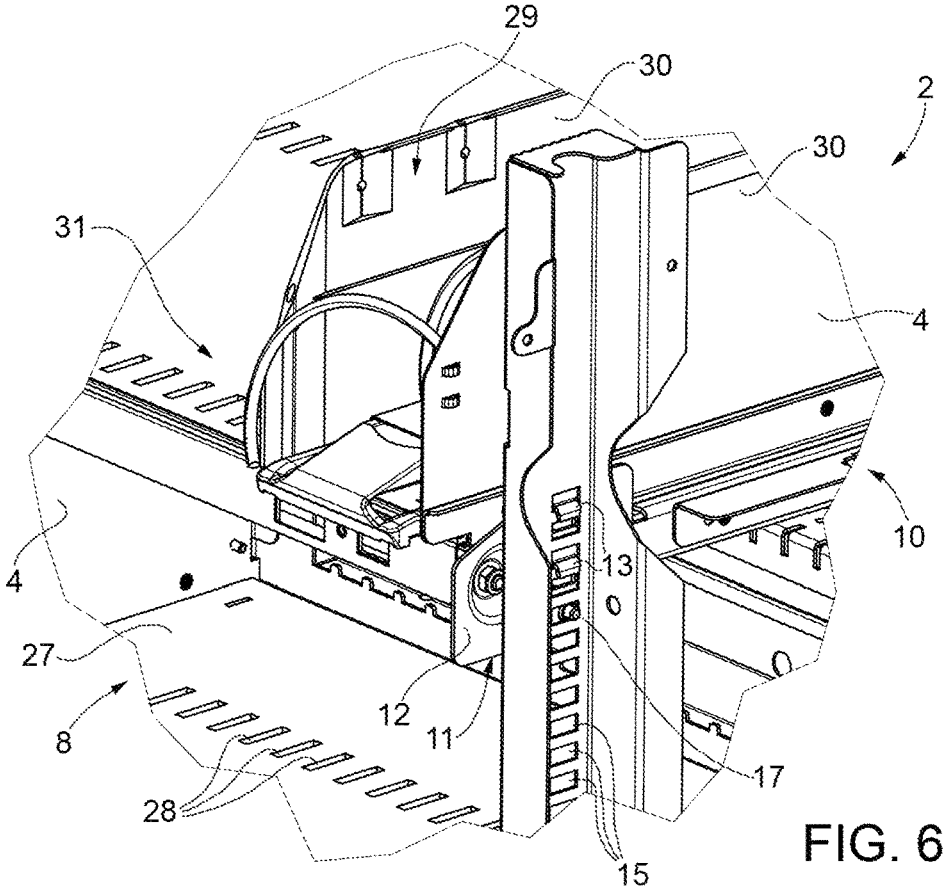
Figure 7:
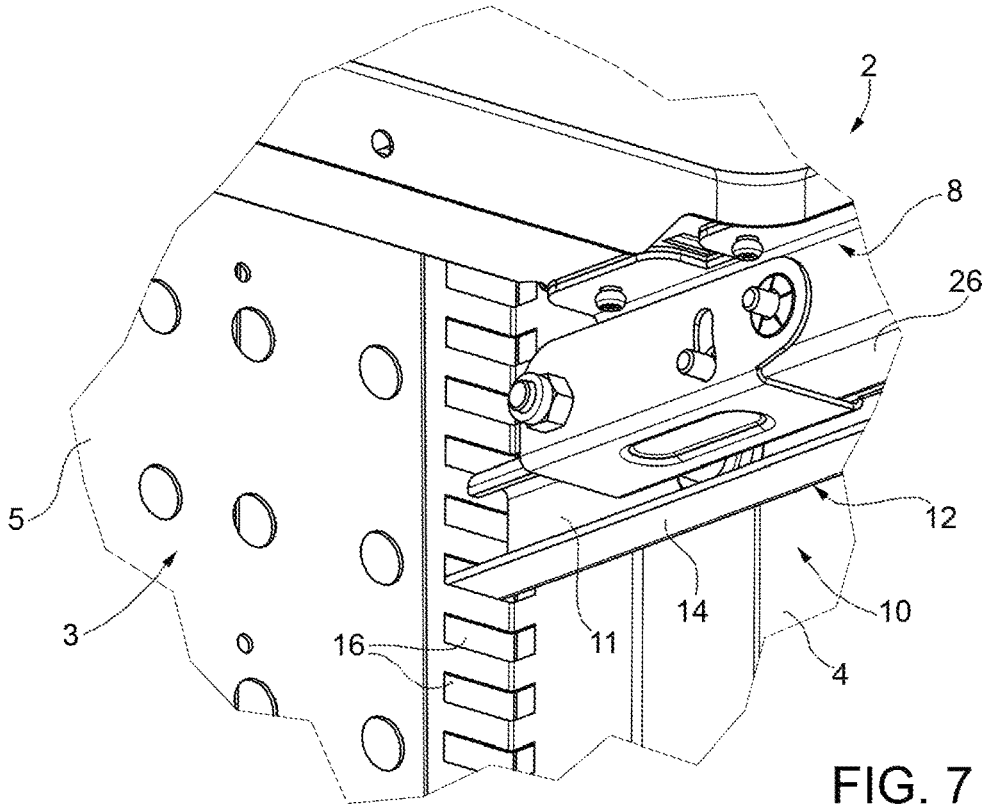
FIG. 7 is a schematic perspective view, with parts removed for clarity's sake, of a further detail of the vending machine of FIG. 1.

With reference to FIGS. 1, 5 and 7, each edge 26 carries a roller 27 (FIG. 7), which slidingly engages, when the tray 8 is mounted between the guides 11, the central U-shaped portion of the corresponding guide 11 to allow the sliding of the tray 8 on the guides 11 when it is inserted into or extracted from the cabinet 2.

The frame of each tray 8 supports a substantially horizontal plate 27, which extends between the walls 4 and has at least two parallel rows of slots 28.

The tray 8 is divided into a parallel plurality of channels 29, arranged side by side, which extend between the wall 5 and the door 6, are designed to house respective pluralities of products (not shown) and are delimited by dividing walls 30 coupled to the plate 27 through the engagement of respective teeth in the slots 28 of the plate 20.

Each channel 29 is provided with an advancement device 31 comprising a helical conveyor mounted to rotate about a longitudinal axis and progressively advance the products (not shown) along the channel 29 and towards the door 6.

The dispenser 1 has some advantages, mainly due to the fact that the presence of the locking pins 17 allows a relatively safe and reliable coupling of the guides 11 to the cabinet 2 and a relatively quick and comfortable release of the guides 11 from the cabinet 2.

The invention claimed is:

1. A vending machine, comprising:

a cabinet internally defining a dispensing compartment closed by a front door;

a plurality of dispensing trays, which are arranged in the dispensing compartment, are arranged one over the other and are each designed to support a respective plurality of products; and for each dispensing tray, a respective guide device, which is slidably engaged by a respective dispensing tray of the plurality of dispensing trays and includes a pair of guides coupled to the cabinet on opposite sides of the dispensing tray;

wherein each guide has an elongated shape and includes a front end provided with at least a first coupling tooth for engagement with the cabinet and a rear end provided with at least a second coupling tooth for engagement with the cabinet;

wherein each guide is further provided with a retractable spring-loaded locking pin, which is movable between a normal extracted coupling position, in which the retractable spring-loaded locking pin locks the relative guide onto the cabinet, and a retracted release position, which allows the respective guide to be mounted to, and removed from, the cabinet.

2. The vending machine of claim 1, wherein the retractable spring-loaded locking pin is configured to allow, when the retractable spring-loaded locking pin is in the retracted release position, the first coupling tooth to engage the respective first slot and the second coupling tooth to engage a respective second slot, and to automatically engage a respective first slot when returning from the retracted release position to the normal extracted coupling position.

3. The vending machine of claim 1, wherein the cabinet includes two pluralities of first slots designed to receive and hold said first coupling tooth.

4. The vending machine of claim 3, wherein the first slots in each of the two pluralities of first slots are aligned in a direction with a first constant pitch.

5. The vending machine of claim 3, wherein each first slot is configured to receive and hold the retractable spring-loaded locking pin.

6. The vending machine of claim 3, wherein the dispensing compartment is bounded by two side walls, the first slots in each plurality of first slots being formed in a respective side wall of the dispensing compartment.

7. The vending machine of claim 4, wherein the retractable spring-loaded locking pin is aligned with the first coupling tooth of the respective guide in said direction, and is spaced apart from the first coupling tooth of a distance equal to said first pitch or to a multiple of said first pitch.

8. The vending machine of claim 1, wherein the cabinet includes two pluralities of second slots designed to receive and hold the second coupling teeth.

9. The vending machine of claim 8, wherein the second slots of each of the two pluralities of second slots are aligned in a direction with a second constant pitch.

10. The vending machine of claim 8, wherein the second slots are formed in a rear wall of the cabinet.

* * * * *